US006666269B1

(12) United States Patent
Bangash et al.

(10) Patent No.: US 6,666,269 B1
(45) Date of Patent: Dec. 23, 2003

(54) METHOD AND APPARATUS FOR PRODUCING FLUID FROM A WELL AND FOR LIMITING ACCUMULATION OF SEDIMENTS IN THE WELL

(75) Inventors: Yasser Bangash, Norman, OK (US); Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 0 days.

(21) Appl. No.: 10/112,324

(22) Filed: Mar. 27, 2002

(51) Int. Cl.[7] ..... E21B 43/00

(52) U.S. Cl. ..... 166/310; 166/68; 166/311; 166/105.4; 137/13; 417/54; 417/65

(58) Field of Search ..... 166/68, 105, 105.1, 166/105.4, 304, 311, 369; 137/13; 417/54, 65

(56) References Cited

U.S. PATENT DOCUMENTS 4,582,131 A * 4/1986 Plummer et al.
4,749,034 A * 6/1988 Vandevier et al.
5,845,709 A 12/1998 Mack et al. ..... 166/302
6,260,627 B1 7/2001 Rivas ..... 166/369

* cited by examiner

*Primary Examiner*—Roger Schoeppel
(74) *Attorney, Agent, or Firm*—McAfee & Taft

(57) ABSTRACT

An electric submersible pumping system provides for the production of fluids from a well and for limiting the amount of sediment accumulation in the well. The apparatus includes an electric submersible pumping system lowered into a well on a production tubing. The electric submersible system includes an electric submersible pump having an intake at or near a lower end thereof. A seal is connected to the intake and a motor is connected to a lower end of the seal. The apparatus further includes an auxiliary pump having an auxiliary pump discharge at an upper end thereof and an auxiliary pump intake at a lower end thereof. The auxiliary pump is connected to the motor. The system is lowered into the well so that it is positioned below the perforations in a well which communicate a producing formation with the interior of the well. The auxiliary pump intake will receive fluid along with sediments that may be produced by the formation. The auxiliary pump will pump the fluid and sediments upwardly through the auxiliary pump discharge and through discharge tubes connected to the discharge. At least a portion of the fluids and sediment pumped upwardly by the auxiliary pump will be communicated into the production pump intake and produced upwardly through the production tubing along with other fluid from the well. Because the auxiliary pump is continuously taking in fluid, there is a downward flow of fluid past the motor in the well which will cool the motor in the electric submersible pumping system.

26 Claims, 3 Drawing Sheets

METHOD AND APPARATUS FOR PRODUCING FLUID FROM A WELL AND FOR LIMITING ACCUMULATION OF SEDIMENTS IN THE WELL

BACKGROUND OF THE INVENTION

The present invention is directed to a submersible pump for producing fluid from well intersecting a producing formation, preferably a hydrocarbon-producing formation, and more particularly is directed to an apparatus for producing fluid from a well and for limiting the accumulation of sediment in wells in which the formation produces solids along with the production fluids.

It is well known that in producing oil and/or gas wells, the fluid in the well may be elevated to the surface by utilizing a pump installed in the well. One type of pump that is often utilized is an electric submersible pump. Electric submersible pumps may be used for a variety of reasons, such as for example in wells where artificial lift is required when formation intersected by the well does not provide the necessary lift to produce the fluid to the surface.

Electric submersible pumps, depending upon the application, are often deployed in wells with open rat holes. That is, the pumps are deployed in wells which have casing cemented in a wellbore to a certain depth and wherein the wellbore is drilled to a greater depth so that there is an uncased, or open rat hole below the casing. In some formations intersected by the well, the fluid produced therefrom will contain solids. The solids tend to get deposited in the rat hole, and over time the deposits, also referred to as sediment, can cause production problems such as reduced well productivity, and cause equipment problems, such as motor overheating. If the electric submersible pump system is deployed in the well below the perforations in the casing through which the formation fluid is communicated into the well, there may be insufficient flow of fluid around the motor in the electric submersible pumping system to cool the motor.

When an electric submersible pump is placed above the perforations, flowing well fluid will produce some motor cooling. When the system is placed below casing perforations, the motor in the electric submersible pumping system is generally not exposed to flowing well fluid. Thus, there is a need for a method and apparatus for limiting the accumulation of sediments in a rat hole and for providing cooling to a motor used in an electric submersible pumping system when the system is placed below perforations in a well.

SUMMARY OF THE INVENTION

The present invention provides a method and apparatus for producing fluid from a well, for limiting the accumulation of sediments in the well, and for providing cooling to motors used in electric submersible pump systems when the system is placed below perforations in the well. The apparatus comprises an electric submersible pumping system lowered into a well on a production tubing. The electric submersible pumping system includes a submersible production pump, a seal section connected to a lower end of the pump, and a submersible motor connected to the seal section for driving the production pump. A production pump intake is positioned at or near the lower end of the production pump above the seal section. A submersible auxiliary pump is connected below the motor. The auxiliary pump has an auxiliary pump intake at or near a lower end thereof, and includes an auxiliary pump discharge positioned between the submersible motor and the auxiliary pump. The auxiliary pump discharge is designed such that the motor is effectively sealed from the auxiliary pump discharge to prevent fluid from the auxiliary pump from being pumped or discharged into the submersible motor. The auxiliary pump discharge has at least one and preferably has a plurality of discharge ports.

The production tubing preferably has a sufficient length so that the electric submersible pumping system is located in the well below the perforations that communicate the producing formation with the interior of the well. Fluid from the well will be drawn in through the auxiliary pump intake, will be pumped upwardly through the auxiliary pump discharge and then upwardly in the well above the submersible motor, which drives both the production pump and the auxiliary pump. In wells where the producing formation produces sediment along with the fluid, some of the sediment that will naturally flow downward in the well due to gravity will be drawn in through the auxiliary pump intake and will be pumped upwardly in the well along with the fluid pumped by the auxiliary pump.

The apparatus preferably includes at least one and preferably a plurality of discharge tubes or discharge tubings connected at a lower end to the auxiliary pump discharge. The discharge tubes extend upwardly in the well past the submersible motor. The tubes may extend upwardly past the production pump intake and may expel the fluid and sediments pumped upwardly therethrough into the interior of the well above the production pump intake. A portion of the fluid expelled from the discharge tubes along with a portion of the sediment will flow downwardly in the well. A portion of the fluid expelled from the discharge tubes along with a portion of the sediment will be taken in through the production pump intake and will, along with other fluid from the well, be produced upwardly by the production pump through the production tubing on which the system is lowered. In a separate embodiment, the upper ends of the discharge tubes may be communicated directly to the production pump intake so that all of the fluid and sediment taken in and pumped upwardly through the discharge tubes by the auxiliary pump will be received in the production pump intake and will be produced upwardly by the production pump through the production tubing. Because the auxiliary pump will pump sediments upwardly so that some sediment can be produced upwardly through the production tubing, the invention limits the accumulation of sediment in the well.

In addition to limiting the accumulation of sediment in the well the present invention provides a method and apparatus for cooling the submersible motor in an electric submersible pumping system when the system is placed below perforations in the well. The auxiliary pump of the present invention pumps fluid upwardly in the well which allows for downward flow of fluid in the well past the motor. The auxiliary pump preferably pumps fluid upwardly at a rate sufficient to create a downward flow in the well of preferably at least about 1 ft/second past the motor, so that the downward flow will provide efficient motor cooling.

It is therefore an object of this invention to provide a method for producing well fluid from a well in which the producing formation produces sediments along with fluid, and for limiting the accumulation of the sediments in the well. It is a further object of the invention to provide a method for producing fluid from a well in which the pumping system is located below the perforations and for cooling the motor utilized in the pumping system.

The foregoing and other objects, advantages and features of the present invention will become apparent upon reading the following detailed description in conjunction with the accompanying drawings.

DETAILED DESCRIPTION OF THE PREFERRED EMBODIMENTS

Figure 1:
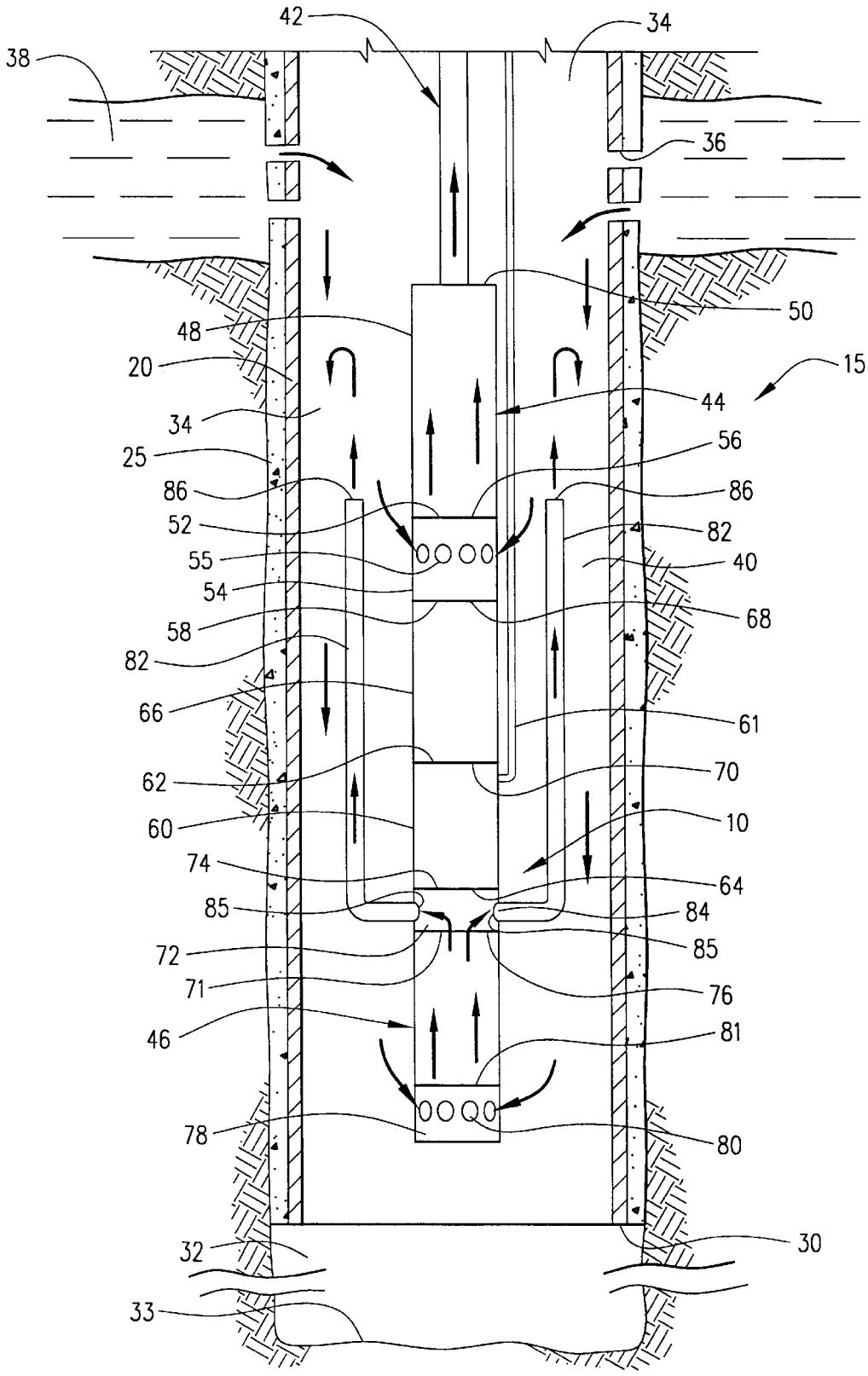
FIG. 1 schematically shows the apparatus of the present invention lowered into a well.

Referring now to the drawings and more specifically FIG. 1, an apparatus 10 for producing fluid from a well 15 is shown and described. Apparatus 10 is shown lowered into a well 15 comprising a casing 20 cemented in a wellbore 25. Casing 20 has a lower end 30, and thus well 15 has an open or uncased rat hole 32 comprising the lower portion of wellbore 25. Well 15 has a bottom 33. Casing 20 defines a casing interior or well interior 34. Production fluids are communicated into well interior 34 through perforations 36, which communicate the interior 34 with producing formation 38. Lower end 30 could be positioned above perforations 32, or could extend below the cement. In the embodiment shown, lower end 30 is below perforations 36. Casing 20 and apparatus 10 define an annulus 40 therebetween.

Apparatus 10 is shown lowered into well 15 on a production tubing 42. Apparatus 10 includes an electric submersible pumping system 44 having an auxiliary pump 46 connected to a lower end thereof.

Electric submersible pumping system 44 includes an electric submersible pump 48 having upper end 50 connected to production tubing 42 and having a lower end 52. An intake 54, having intake ports 55, is connected to the lower end 52 of electric submersible pump 48, which may also be referred to as production pump 48. Intake 54 has upper end 56 and lower end 58. Production pump intake 54 may be connected to or may be integrally formed with production pump 48. A motor 60 for driving production pump 48 is connected in electric submersible pumping system 44 below intake 54. Motor 60 is connected to a power source (not shown) with power cable 61. The motor 60 has an upper end 62 and a lower end, or motor base 64. A seal section 66 is connected between motor 60 and intake 54. Seal section 66 is connected at its upper end 68 to intake 54 and at its lower end 70 to motor 60. Motor 60 is thus connected to the lower end of pump 48 with seal section 66 and intake 54. Production pump 48, intake 54, motor 60 and seal section 66 are all known in the art.

Auxiliary pump 46 is connected at its upper end 71 to the lower end 64 of motor 60 with an auxiliary pump discharge 72, which may be referred to as a pump discharge head 72. Auxiliary pump 46 can be a standard electric submersible pump connected to the lower end 64 of motor 60 at auxiliary pump discharge 72, so that auxiliary pump 46 pumps in the same direction as production pump 48. The arrangement can be reversed if desired. Auxiliary pump discharge 72 has upper end 74 connected to motor 60 and lower end 76 connected at upper end 71 of auxiliary pump 46. Auxiliary pump discharge 72 incorporates a high pressure mechanical seal which connects to motor base 64. Auxiliary pump 46 has an auxiliary pump intake 78 comprising a plurality of intake ports 80 connected to the lower end 81 thereof. Pump intake 78 may be integrally formed with or it may be connected to auxiliary pump 46 in any manner known in the art.

Figure 2:
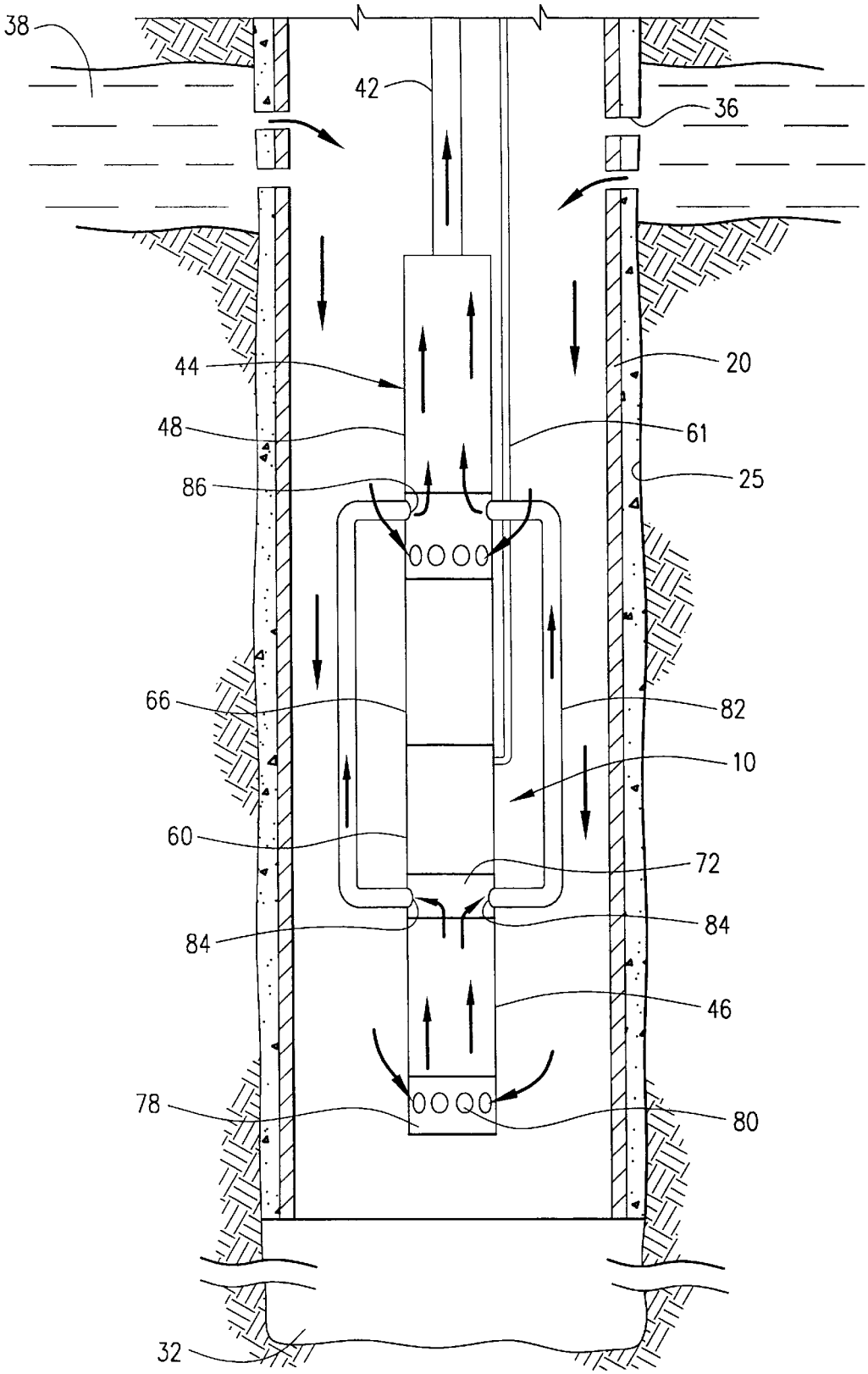
FIG. 2 shows a second embodiment of the apparatus of the present invention.

Apparatus 10 includes at least one, and in the embodiment shown includes two, discharge tubings 82. Discharge tubings 82 have a lower end 84 and an upper end 86. Lower end 84 is connected with auxiliary pump discharge 72 at discharge ports 85. Discharge tubing 82 extends upwardly therefrom and terminates at upper end 86 above seal 66. In the embodiment shown in FIG. 1, upper end 86 is positioned above intake ports 55 in intake 54. FIG. 2 shows an embodiment of the present invention in which upper ends 86 are connected directly to intake 54.

Figure 3:
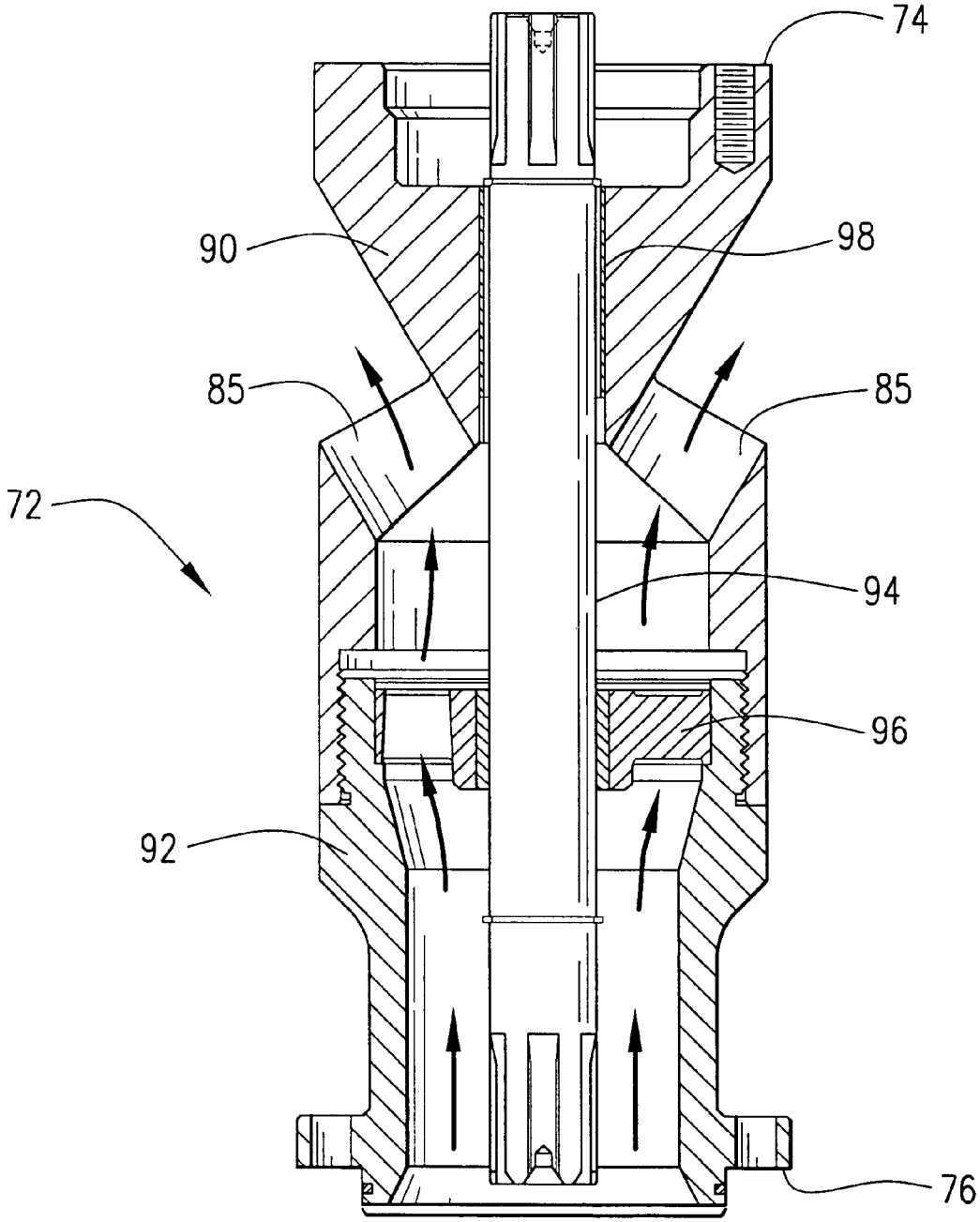
FIG. 3 shows an embodiment of a discharge head of the present invention.

An embodiment of an auxiliary pump discharge 72 is shown in FIG. 3. Auxiliary pump discharge 72 may comprise an upper portion 90 threadably connected to a lower portion 92. A shaft portion 94 extends through both upper portions 90 and 92 and as understood in the art will be connected to a shaft that extends upwardly into and through motor 60 to drive electric submersible pump 48 and will also extend downwardly into and will drive auxiliary pump 46. A spider bearing 96 supports shaft portion 94 and, as known in the art, will allow fluid flow upwardly through discharge head 72. Shaft portion 94 is sealingly disposed in upper portion 90 with a high pressure seal 98. As set forth previously, auxiliary pump discharge 72 is connected at its upper end 74, which is defined on upper portion 90 to motor 60. Auxiliary pump discharge 72 is connected at its lower end 76 to auxiliary pump 46.

The operation of apparatus 10 is as follows. Apparatus 10 is lowered into the well is on a production tubing 42 until it is positioned below perforations 36. Fluid from formation 38 is communicated into well interior through perforations 36. Sediment in fluids from formation 38 may also be communicated into well interior 34 through perforations 36. Once apparatus 10 is in place, motor 60 is actuated. Motor 60 drives production pump 48 and also drives auxiliary pump 46. Once motor 60 is actuated to drive pumps 48 and 46, production pump 48 will draw fluid from interior 34 through intake 54. Auxiliary pump 46 will draw fluid from interior 34 through ports 80 in intake 78. Fluid drawn in through intake 78 is discharged through discharge ports 85 in auxiliary pump discharge 72 into discharge tubings 82 through the lower ends 84 thereof.

In the embodiment shown in FIG. 1, well fluid from auxiliary pump 46 is discharged out the upper ends 86 of discharge tubings 82. A portion of the well fluid expelled from discharge tubing 82 will be drawn in through intake 54 and will, along with other well fluid drawn in through intake 54, be produced up production tubing 42 with production pump 48. A portion of the fluid expelled from the upper end 86 of tubings 82 will, due to gravity, flow downwardly in the well, some of which will again be taken in through intake 78 along with other fluid in the well. Production pump 48 will produce additional fluid from the well through intake 54 and production tubing 42, along with the fluid and any sediment pumped upwardly by auxiliary pump 46.

In wells where sediments are produced with fluid from the producing formation, the fluid drawn into auxiliary pump 46 will contain some sediments and will thus keep the sediments from falling to the bottom of the rat hole. Fluid that enters the auxiliary pump, along with the sediments therein, will be pressurized and produced through the discharge tubing 82. In the embodiment shown in FIG. 1, a portion of that fluid including some of the sediment therein, will be drawn in through intake 54 and produced up the production tubing 42. In the embodiment shown in FIG. 2, all of the fluid and all of the sediment taken in through intake 78 is communicated through discharge tubings 82 directly into intake 54, so that all of the fluid and sediment drawn in through intake 78 will be produced upwardly by production pump 48 through tubing 42.

In addition to limiting the amount of sediment that will collect at the bottom of the rat hole, the present design provides for motor cooling in electric submersible pumping systems positioned below perforations. The system may be designed such that pump 46 draws fluid into intake 78 at a rate such that downward flow of the fluid in the well is at a sufficient velocity, preferably at least about 1 ft/second, past the motor. In the embodiment shown in FIG. 2, the auxiliary pump may also act as a charge pump since the fluid therein will have little or no free gas and is communicated directly into intake 54 and thus will reduce the gas fraction feed into the production pump that might otherwise cause gas locking in wells having a high amount of gas.

While the invention may be susceptible to various modifications and alternative forms, specific embodiments have been shown in the drawings and have been described in detail by way of example only. It is understood that the invention is not intended to be limited by the particular forms or embodiments disclosed. Rather, the invention covers all modifications, equivalents, and alternatives falling within the spirit and scope of the invention as defined by the following appended claims.

What is claimed is:

1. An apparatus for producing fluid from a well intersecting a fluid producing formation, the apparatus comprising:

a first submersible pump having a first intake for receiving fluid from said well, wherein the fluid received in the first intake is pumped upwardly in said well by the first submersible pump;

a seal section connected to said first submersible pump;

a motor connected to said seal section for driving said first submersible pump;

a second submersible pump positioned below said motor, said second submersible pump having a second intake at or near a lower end thereof for receiving fluid from said well;

a pump discharge located between said motor and said second intake, said pump discharge defining at least one discharge port; and at least one discharge tubing connected to said pump discharge and extending upwardly therefrom in said well, said discharge tubing being communicated with said at least one discharge port, wherein said second submersible pump urges the fluid received in the second intake upwardly through said at least one discharge tubing.

2. The apparatus of claim 1, wherein the fluid urged upwardly through said discharge tubing is discharged from said discharge tubing above said motor.

3. The apparatus of claim 2, wherein the fluid urged upwardly through said discharge tubing is discharged directly into said first intake of the first submersible pump.

4. The apparatus of claim 2, wherein said fluid urged upwardly through said at least one discharge tubing is expelled through an open end thereof into an interior of said well above said motor.

5. The apparatus of claim 1, wherein said pump discharge comprises a plurality of discharge ports, each said discharge port having a discharge tubing communicated therewith.

6. The apparatus of claim 1, wherein each of said first and second submersible pumps is adapted to produce sediment upwardly.

7. A method of producing fluid from a cased well, the cased well defining a well interior, the casing having perforations therethrough to communicate fluid from a formation intersected by said well into the well interior, the method comprising:

lowering an electric submersible pumping system into the well on a production tubing, the electric submersible pumping system comprising a production pump, a motor for driving said production pump, said motor being positioned below said pump, and an auxiliary pump positioned below said motor;

urging fluid from the well interior upwardly through at least one discharge tube with said auxiliary pump;

discharging the fluid from said at least one discharge tube above said motor; and pumping fluid from the well interior upwardly through said production tubing with said production pump, wherein the fluid pumped upwardly through the production tubing comprises at least a portion of the fluid discharged from the discharge tube and additional fluid drawn into the production pump from the well interior.

8. The method of claim 7, wherein said discharging step comprises discharging said fluid from said at least one discharge tube directly into an intake of said production pump.

9. The method of claim 7 further comprising positioning said electric submersible pumping system below said perforations in said well.

10. The method of claim 9, wherein said auxiliary pump draws fluid from the well interior into an auxiliary pump intake at a rate sufficient to cause a flow of fluid in the well interior downwardly past said motor to cool said motor.

11. An apparatus for producing well fluid from a well intersecting a producing formation, the well having a casing therein, the casing having perforations for communicating fluid from said formation into a well interior, the apparatus comprising:

a production pump lowered into said well on a production tubing;

a motor positioned below said production pump for driving said production pump;

an auxiliary pump connected to a lower end of said motor;

an auxiliary pump intake for receiving said well fluid; and an auxiliary pump discharge for discharging said well fluid received in said auxiliary pump intake.

12. The apparatus of claim 11, further comprising at least one discharge tube connected at a first end to said auxiliary pump discharge, said at least one discharge tube having a second end, said second end being located above said motor.

13. The apparatus of claim 12, wherein said second end of said at least one discharge tube is connected to an intake of said production pump, so that all of said well fluid discharged from said discharge tube is communicated into said intake of said production pump.

14. The apparatus of claim 12, wherein said well fluid received in said auxiliary pump intake is discharged through said second end of said at least one discharge tube into the well interior above said motor.

15. The apparatus of claim 12, wherein said well fluid received in the auxiliarm pump intake is discharged through said second end of said at least one discharge tube into said well interior above an intake for said production pump.

16. The apparatus of claim 11, wherein said motor drives said auxiliary pump.

17. The apparatus of claim 11, wherein said production tubing has a length such that said production pump is positioned below said perforations in said casing.

18. A method for limiting the accumulation of sediment in the bottom of a well in which a producing formation produces sediment along with a production fluid, the well having perforations to communicate said producing formation with said well, the method comprising:

lowering an electric submersible pumping system into said well on a production tubing, the electric submersible pumping system comprising a production pump, an auxiliary pump, and a motor between said production pump and said auxiliary pump;

positioning said electric submersible pumping system below said perforations;

pumping production fluid in said well, along with sediment falling downwardly in said well, upwardly with said auxiliary pump past said motor; and producing at least a portion of said production fluid and sediment pumped by said auxiliary pump upwardly through a production tubing with said production pump.

19. The method of claim 18, wherein all of said production fluid and sediment pumped by said auxiliary pump is produced upwardly by said production pump.

20. The method of claim 18, further comprising:

expelling said production fluid and sediment pumped by said auxiliary pump into said well above said motor; and allowing a portion of said production fluid and said sediment pumped by said auxiliary pump to flow downwardly in said well past said motor.

21. The method of claim 18, further comprising producing additional production fluid from said well through said production tubing with said production pump along with said at least a portion of said production fluid and sediment pumped upwardly by said auxiliary pump.

22. A method for producing fluid from a well intersecting a producing formation, comprising:

lowering an electric submersible pumping system into said well, the pump system comprising a first submersible pump, a second submersible pump positioned below said first submersible pump, and a motor between said first and second submersible pumps for driving both said pumps;

withdrawing fluid from said well with said second submersible pump to create a downward flow in the well past said motor at a rate sufficient to cool said motor;

discharging said fluid withdrawn by said second submersible pump into said well above said motor; and producing fluid from said well upwardly through a production tubing with said first submersible pump, wherein the fluid produced upwardly through the production tubing comprises fluid received from the well in an intake for the first submersible pump.

23. The method of claim 22, said discharging step comprising:

communicating said fluid withdrawn by said second submersible pump upwardly past said motor through at least one discharge tube; and expelling said fluid withdrawn by said second submersible pump from said at least one discharge tube above said motor.

24. The method of claim 23, said expelling step comprising expelling said fluid from said at least one discharge tube directly into an intake of said first submersible pump.

25. The method of claim 23, said expelling step comprising expelling said fluid from said at least one discharge tube into an interior of said well above said motor.

26. The method of claim 22, wherein said second pump withdraws sediment along with fluid, and wherein at least a portion of the fluid and sediment discharged into said well above said motor is produced upwardly through the production tubing by said first submersible pump, along with additional fluid from the well.

* * * * *